US009149912B2

(12) United States Patent
Soma et al.

(10) Patent No.: US 9,149,912 B2
(45) Date of Patent: Oct. 6, 2015

(54) CUBIC BORON NITRIDE GRINDING WHEEL

(75) Inventors: Shinji Soma, Kashiwara (JP); Naoto Ono, Anjo (JP); Tomokazu Yamashita, Nishio (JP)

(73) Assignee: JTEKT CORPORATION, Osaka-shi (JP)

( * ) Notice: Subject to any disclaimer, the term of this patent is extended or adjusted under 35 U.S.C. 154(b) by 0 days.

(21) Appl. No.: 13/217,432

(22) Filed: Aug. 25, 2011

(65) Prior Publication Data

US 2012/0073211 A1 Mar. 29, 2012

(30) Foreign Application Priority Data

Sep. 27, 2010 (JP) ..... 2010-214774

(51) Int. Cl.

| | |
|---|---|
| ***B24B 1/00*** | (2006.01) |
| ***B24D 11/00*** | (2006.01) |
| ***B24D 3/34*** | (2006.01) |
| ***B24D 3/14*** | (2006.01) |
| ***B24D 5/00*** | (2006.01) |

(52) U.S. Cl.
CPC *B24D 3/342* (2013.01); *B24D 3/14* (2013.01); *B24D 5/00* (2013.01)

(58) Field of Classification Search
None
See application file for complete search history.

(56) References Cited

U.S. PATENT DOCUMENTS

| | | | | |
|---|---|---|---|---|
| 3,768,972 | A * | 10/1973 | Taylor et al. | 23/300 |
| 4,923,490 | A | 5/1990 | Johnson et al. | |
| 5,000,760 | A * | 3/1991 | Ohtsubo et al. | 51/293 |
| 2008/0222965 | A1 | 9/2008 | Querel et al. | |
| 2008/0302023 | A1 * | 12/2008 | Goudemond et al. | 51/309 |
| 2010/0139173 | A1 | 6/2010 | Soma et al. | |

FOREIGN PATENT DOCUMENTS

| | | | |
|---|---|---|---|
| EP | 1 598 147 | A2 | 11/2005 |
| EP | 2 193 881 | A2 | 6/2010 |
| JP | 8-257920 | A | 10/1996 |
| JP | 9-150370 | A | 6/1997 |
| JP | 9-267266 | | 10/1997 |
| JP | 09267266 | A * | 10/1997 |
| JP | 11-277439 | | 10/1999 |
| JP | 11-277440 | | 10/1999 |
| JP | 2002-127011 | A | 5/2002 |
| JP | 2008-200780 | | 9/2008 |
| JP | 2010-131699 | | 6/2010 |
| WO | WO 2008/112914 | A2 | 9/2008 |

OTHER PUBLICATIONS

Extended European Search Report issued May 16, 2014 in Patent Application No. 11180246.8.
Japanese Office Action issued Jul. 29, 2014 in Patent Application No. 2010-214774 (Partial English Translation Only).

* cited by examiner

*Primary Examiner* — Kaj K Olsen
*Assistant Examiner* — Ross J Christie
(74) *Attorney, Agent, or Firm* — Oblon, McClelland, Maier & Neustadt, L.L.P.

(57) ABSTRACT

A CBN grinding particle included in a CBN grinding wheel has a single crystal CBN grinding particle having a tetrahedron construction and a multi crystal CBN grinding particle. The single crystal CBN grinding particle is blended with a ratio of equal to or more than 50% to a total summed volume of the single and multi CBN grinding particles. A CBN grinding wheel having the CBN grinding particle is especially suitable for rough grinding.

15 Claims, 3 Drawing Sheets

CUBIC BORON NITRIDE GRINDING WHEEL

INCORPORATION BY REFERENCE

The present application claims priority under 35 U.S.C. §119 to Japanese Patent Applications No. 2010-214774, filed on Sep. 27, 2010. The content of this application is incorporated herein by reference in the entirety.

BACKGROUND OF THE INVENTION

1. Field of the Invention

The present invention relates to a cubic boron nitride (hereinafter referred as CBN) grinding wheel formed by including the CBN grinding particles.

2. Description of the Related Art

In a prior CBN grinding wheel such as Japanese Patent Laid-open Publication Tokkai 2010-131699 is disclosed a CBN grinding wheel having one kind of CBN grinding particles. In the other prior CBN grinding wheel such as Japanese Patent Laid-open Publication Tokkaihei 9-267266 is disclosed a CBN grinding wheel having both of a single crystal CBN grinding particle and a multi crystal CBN grinding particle. The single crystal CBN grinding particle has good sharpness of cutting by generating cutting portion autogeneously and the multi crystal CBN grinding particle has good finishing by superior strength of the grinding particle itself as disclosed in the Japanese Patent Laid-open Publication Tokkaihei 9-267266.

In general, it is needed for a grinding wheel to reduce grinding force and wear in a rough grinding. Reducing the grinding force results to restrain a calorific value and to improve machining efficiency. Reducing wear improves the grinding wheel life.

SUMMARY OF THE INVENTION

In view of the previously mentioned circumstances, it is an object of the present invention to provide a cubic boron nitride grinding wheel especially suitable for a rough grinding.

In order to achieve the above and other objects, one aspect of the present invention provides a cubic boron nitride (hereinafter referred as CBN) grinding wheel formed by bonding the CBN grinding particle by an adhesive material, wherein the CBN grinding particle includes a single crystal CBN grinding particle having a tetrahedron construction and a multi crystal CBN grinding particle, and a volume ratio of the single crystal CBN grinding particle to a total summed volume of the single and multi CBN grinding particles is equal to or more than 50%. Since the single crystal CBN grinding particle having the tetrahedron construction has a sharpened cleavage surface, the single crystal CBN grinding particle contributes to reduce the grinding force. On the other hand, since the multi crystal CBN grinding particle has character of high tenacity, the multi crystal CBN grinding particle has a tendency not to be worn itself. Therefore, it is tendency that the multi crystal CBN grinding particle can be located in far position from the surface of the CBN grinding wheel and the single crystal CBN grinding particle having the tetrahedron construction is located in inside position along a radial direction from the multi crystal CBN grinding particle. By this construction, the multi crystal CBN grinding particle can receive larger force in comparison with the single crystal CBN grinding particle receiving smaller force. By these constructions on the surface of the CBN grinding wheel, the single crystal CBN grinding particle having the tetrahedron construction can reduce the grinding force in a way that the multi crystal CBN grinding particle can achieve its superior wear resistance. Since the volume ratio of the single crystal CBN grinding wheel particle is equal to or more than 50% volume, the single crystal CBN grinding wheel particle having the tetrahedron construction is steadily positioned to be able to grind a workpiece. Therefore, the CBN grinding wheel according to the present invention can achieve a useful character needed for the rough grinding.

The second aspect of the present invention provides mainly the adhesive material not including therein continuous cavities to be communicated to an atmosphere but including therein individually isolated fine cavities not to be communicated to said atmosphere. In general, a CBN grinding wheel having continuous cavities has tendency having a bad holding force of the grinding particle so that it is difficult to hold both of the single crystal CBN grinding particle and the multi crystal CBN grinding particle in their original states. Therefore, the prior CBN grinding wheel has a difficulty of achieving to improve wearing resistance and to reduce the grinding wheel life. In general, a CBN grinding wheel were able to be manufactured without any cavities in the adhesive material so that the CBN grinding wheel is able to improve holding force but has a trouble to make dressing, therefore the CBN grinding wheel is not manufactured actually. The CBN grinding wheel according to the second aspect however includes the individually isolated fine cavities so that it can achieve high holding force, thereby to keep the single crystal CBN grinding particle and the multi crystal CBN grinding particle in their original states. As a result, the present invention can improve the wear resistance and reduce the grinding force.

The third aspect of the present invention provides mainly the adhesive material including an oxide material and an amorphous glass. Thereby, the oxide material and the amorphous glass act as a foam material to make the individually isolated fine cavities achieving the above-explained effects.

BRIEF DESCRIPTION OF THE DRAWINGS

Various other objects, features and many of the attendant advantages of the present invention will be readily appreciated as the same becomes better understood by reference to the following detailed description of the preferred embodiments when considered in connection with the accompanying drawings, in which.

DETAILED DESCRIPTION OF THE PREFERRED EMBODIMENTS

Figure 1:
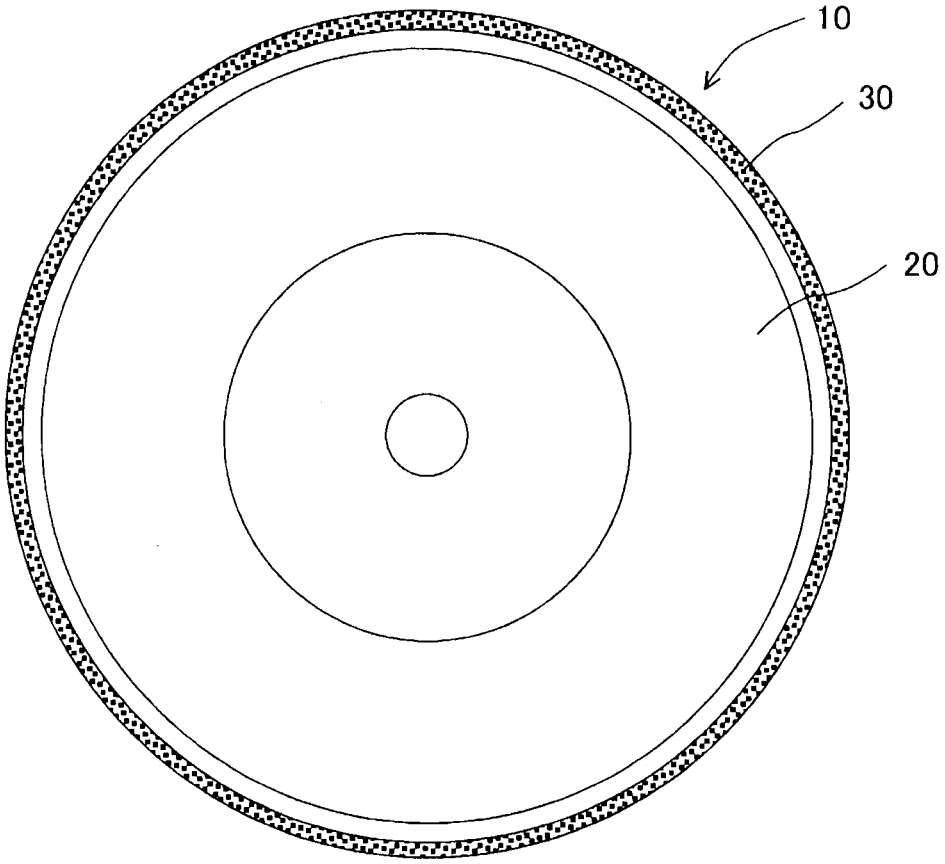
FIG. 1 is a diagram of a grinding wheel by being viewed from an axis direction.

A preferred embodiment of a grinding wheel having a cubic boron nitride (hereinafter referred as CBN) grinding wheel according to the present invention will be described in referring to FIG. 1 and FIG. 2. A grinding wheel 10 includes a base 20 being like a circular disk formed with a metal such as an iron, an aluminum and so on, a plurality of segments of a CBN grinding wheel 30 bonded on an outer peripheral surface of the base 20 as shown in FIG. 1. The plural segments of the CBN grinding wheel 30 consist of plural arc segments with a thickness of 5 to 10 mm along a radial direction and are gathered and aligned to be formed as one annular circular shape.

Figure 2:
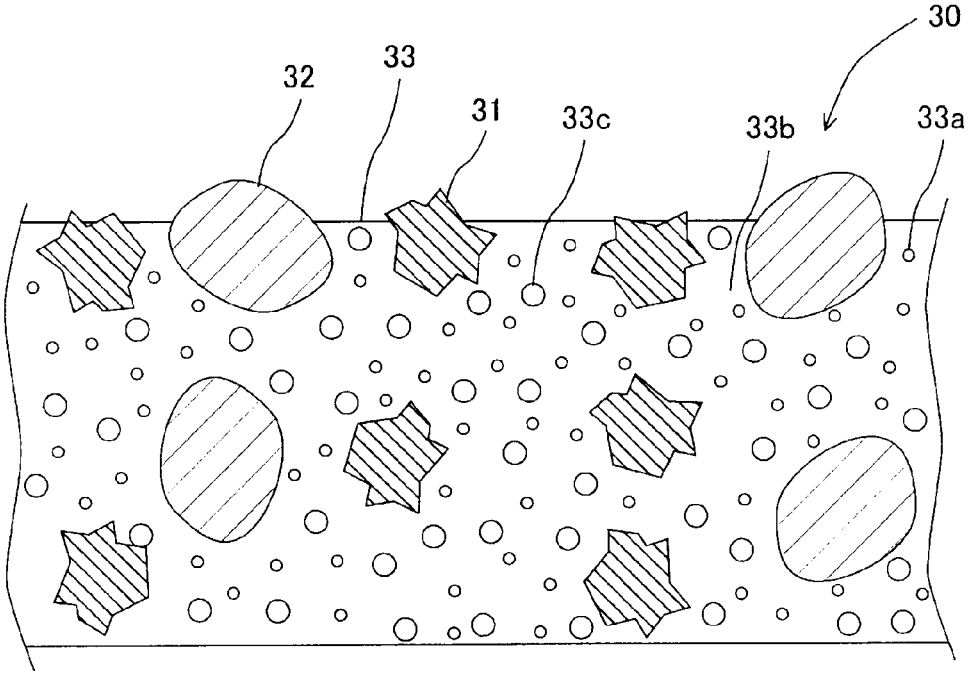
FIG. 2 is a schematic view of a CBN grinding wheel.

Each of the CBN grinding wheel 30 includes a single crystal CBN grinding particle 31 having a tetrahedron construction, a multi crystal CBN grinding particle 32 and a vitrified bond adhesive material 33 as shown in FIG. 2.

The single crystal CBN grinding wheel 31 having the tetrahedron construction has character being able to be torn or broken relatively easily by load thereby to become a state having a sharpened cleavage surface. The sharpened cleavage surface is distinctively appeared because of the tetrahedron construction. The multi crystal CBN grinding particle 32 has character of high tenacity. The CBN grinding wheel 30 has the single crystal CBN grinding particle 31 of equal to or more than 50% volume ratio of a total volume summing the volumes of the single crystal CBN grinding particle 31 and the multi crystal CBN grinding particle 32. A ratio of an average diameter of the single crystal CBN grinding particle 31 to that of the multi crystal CBN grinding particle 32 is between three-fifths (3/5) and four-fifths (4/5). It will be described hereinafter about detail contents of the volume ratio and the average diameter ratio.

The vitrified bond adhesive material 33 consists of an oxide particle 33*a* and an amorphous glass 33*b*. The vitrified bond adhesive material 33 covers on surfaces of the single crystal CBN grinding particle 31 and the multi crystal CBN grinding particle 32 respectively in order to bond the single crystal CBN grinding particle 31 and the multi crystal CBN grinding particle 32 each other. A predetermined number of individually isolated fine cavities 33*c* are filled within the vitrified bond adhesive material 33. Each of the individually isolated fine cavities 33*c* is constructed not to be exposed to atmosphere. From the above-identified construction the individually closed fine cavities 33*c* are not continuous cavities communicated to the atmosphere. Therefore, the vitrified bond adhesive material 33 does not include the continuous cavities communicated to the atmosphere.

The vitrified bond adhesive material 33 will be explained hereinafter in detail. The oxide particle 33*a* is added for the purpose to reinforce intensity of the amorphous glass 33*b* and is selected from one of zircon ($ZrSiO_4$), titania ($TiO_2$), zirconia ($ZrO_2$), chromia ($Cr_2O_3$), aluminum oxide ($Al_2O_3$), etc. as a silicate mineral. The amorphous glass 33*b* can be selected from borosilicate glass, phosphate glass, borate glass, etc. Each of coefficients of linear thermal expansion of the oxide particle 33*a* and the amorphous glass 33*b* is substantially equal to the coefficient of linear thermal expansion of the CBN grinding particles 31, 32 after bonded. The coefficient of linear thermal expansion is likely within the range of $(3.5\pm2)\times10^{-6}/°$ C. (three point five plus or minus two times ten to the minus six power per Celsius degrees). Under this condition, the CBN grinding particles 31, 32, the oxide particle 33*a* and the amorphous glass 33*b* are not separated caused by temperature changes, thereby to maintain quality of the CBN grinding wheel 30.

The oxide particle 33*a* and the amorphous glass 33*b* constructing the vitrified bond adhesive material 33 are mixed and formed in a volume ratio of between 3 to 7 and 4 to 6. This is the reason that fluidity of the amorphous glass 33*b* can not be restrained so that a profile of the CBN grinding wheel 30 is destroyed its corner to be round during or after baking if the volume ratio of the oxide particle 33*a* is under 30%. And also if the volume ratio of the oxide particle 33*a* is over 40%, the amorphous glass 33*b* including the oxide particle 33*a* becomes to be stiff and hard too much so that dressing ability turns to be worse and a calorific value is large thereby to cause a grinding burning. As a result, the CBN grinding wheel 30 is constructed that the volume ration of the oxide particle 33*a* is between 30% and 40% in order that the CBN grinding wheel 30 is burned to be desired profile with adequate stillness.

It is best for the CBN grinding wheel 30 to be manufactured in a way that the volume ratio of the vitrified bond adhesive material 33 to the total summed volume of the CBN grinding particles 31, 32 is between 1 to 1 and 6 to 1. The volume ratio corresponds to be from 50 to 200 in a concentrating degree of the CBN grinding particles 31, 32. The low concentrating degree results that the CBN grinding wheel 30 does not receive any large grinding force from the beginning thereby not to make the grinding burning.

The vitrified bond adhesive material 33 added zircon ($ZrSiO_4$) as the oxide particle 33*a* and burned covers the periphery of the CBN grinding particles 31, 32 and is embedded in a space between the CBN grinding particles 31, 32, and bonds each of the CBN grinding particles 31, 32. The plurality of individually isolated fine cavities 33*c* are formed with a predetermined volume ratio within the vitrified bond adhesive material 33 and embedded in the space between the CBN grinding particles 31, 32. The individually isolated fine cavity 33*c* is a cavity individually closed or isolated without communicating with an atmosphere. The predetermined volume ratio is a volume ratio suitable for maintaining keeping and holding force of the vitrified bond adhesive material 33 with the CBN grinding particles 31, 32 and for maintaining the dressing ability to the vitrified bond adhesive material 33. The predetermined volume ratio of the individually isolated fine cavities 33*c* to the amorphous glass 33*b* of the vitrified bond adhesive material 33 is best as 8%±4%. Controlling of the volume ratio of the individually isolated fine cavities 33*c* is achieved by adjusting volume of foam material mixed in a process of manufacturing explained hereinafter. An average diameter of the individually isolated fine cavities 33*c* is best to be formed from 1% to 12 or 13% of the vitrified bond adhesive material 33.

"Manufacturing Process of the Grinding Wheel"

The manufacturing process of the grinding wheel 10 will be explained hereinafter. At first, the manufacturing process of the circular CBN grinding wheel 30 will be explained. Powders of the oxide particle 33*a* and the amorphous glass 33*b* are mixed evenly and a ratio of a total volume of the integrated oxide particles 33*a* to a total volume of the integrated amorphous glasses 33*b* is from 3 to 7 to 4 to 6. The single crystal CBN grinding particle 31 having the tetrahedron construction and the multi crystal CBN grinding particle 32 are mixed evenly in a state that the volume ratio of the single crystal CBN grinding particle 31 to the multi crystal CBN grinding particle 32 is from 90 to 10 to 50 to 50. It is regulated that the ratio of the average diameter of the single crystal CBN grinding particle 31 to the average diameter of the multi crystal CBN grinding particle 32 is from three-fifths (3/5) to four-fifths (4/5).

The single crystal CBN grinding particle 31 and the multi crystal grinding particle 32 are mixed into the vitrified bond adhesive material 33 to be scattered evenly. The volume ratio of the vitrified bond adhesive material 33 to the total volume of the CBN grinding particles 31, 32 is between 1 to 1 and 6 to 1.

The foam material forming the individually isolated fine cavities 33*c* in the vitrified bond adhesive material 33 is hexagonal boron nitride (hBN) and powders of the hBN is mixed evenly. The amount of the foam material is from 0.5% to 2% volume of the amorphous glass 33*b*. The foam material may be fluorite ($CaF_2$) or calcium carbonate ($CaCO_3$).

The mixture of the vitrified bond adhesive material 33, CBN grinding particles 31, 32 and foam material are entered into a die to be pressed by predetermined pressure and then burned. The bonding force of the vitrified bond adhesive material 33 is adjusted by adjusting pressure for pressing. The hBN as the foam material and the amorphous material 33*b* are reacted to generate gas during burning. The generated gas becomes the individually isolated fine cavity 33*c* formed in the vitrified bond adhesive material 33.

The plural individually isolated fine cavities 33*c* are formed in the vitrified bond adhesive material 33 to manufacture the CBN grinding wheel 30 having the single crystal CBN grinding particle 31 with the tetrahedron construction and the multi crystal CBN grinding particle 32 by the above manufacturing process. It is good to make the average diameter of the individually isolated fine cavity 33*c* with from 1% to 12 or 13% of the average diameter of the CBN grinding particles 31, 32. For example, it is good that the average diameter of the individually isolated fine cavity 33*c* is from 1 micrometer to 12 or 13 micrometers where the average diameter of the CBN grinding particles 31, 32 is 100 micrometers by adjusting the amount of the foam material. The grinding wheel 10 is completed by bonding the plural arc segments of the manufactured CBN grinding wheel 30 to the peripheral surface of the body 20 as shown in FIG. 1.

"Evaluation Test"

It is explained the evaluation test of the CBN grinding wheel 30 about a grinding wheel life and grinding force.

"Evaluation Condition"

The evaluation condition is as follows. A workpiece is made of a ductile iron (FCD) and is a cylindrical form with induction hardening on its outer peripheral surface. The grinding wheel 10 is a disk like form with a diameter of 350 mm. A surface speed is 80 m/s (eighty meters per second) and grinding efficiency is 50 $mm^3$/mm/s (fifty cubic millimeters per millimeter per second).

In relating to the CBN grinding wheel 30 consisting of the grinding wheel 10, it is prepared several types of the volume ratio of the single crystal CBN grinding particle 31 to the multi crystal CBN grinding particle 32 and the average diameter ratio of the single crystal CBN grinding particle 31 to the multi crystal CBN grinding particle 32. In this embodiment of the present invention, the prepared four types of the volume ratio of the single crystal CBN grinding particle 31 to the multi crystal CBN grinding particle 32 are 100 to 0, 90 to 10, 75 to 25 and 0 to 100. At the types having both of the single crystal CBN grinding particle 31 and the multi crystal CBN grinding particle 32, the two types of the average diameter ratio of the single crystal CBN grinding particle 31 to the multi crystal CBN grinding particle 32 are 1 to 1 and 2 to 3.

"Result of Test"

Figure 3:
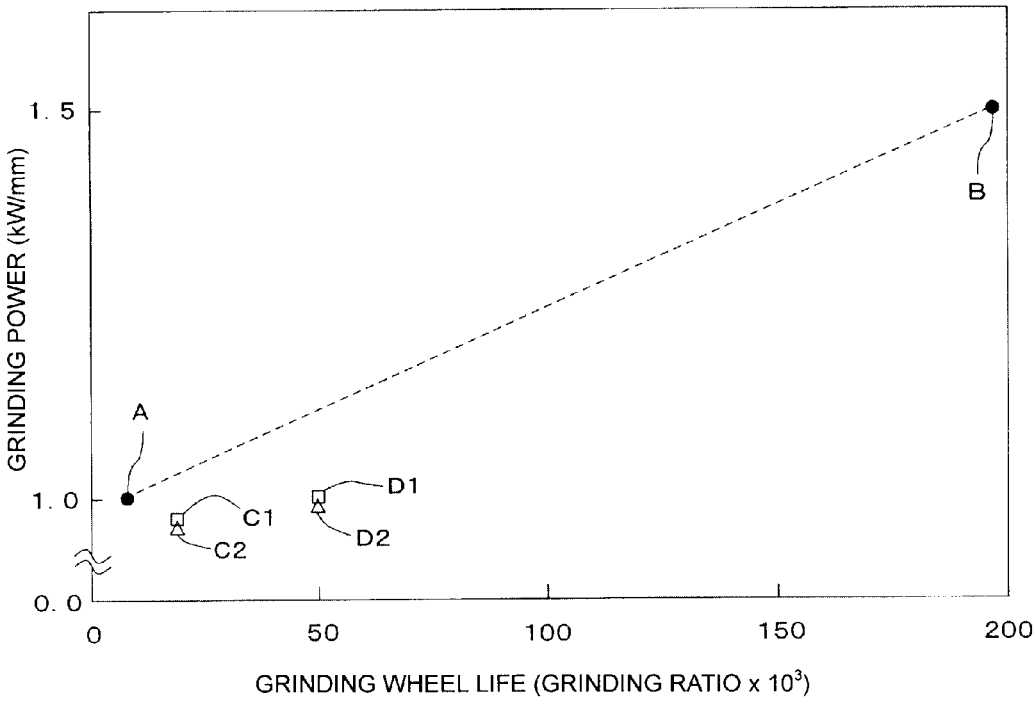
FIG. 3 is a graph showing a relation of grinding wheel life and grinding power of a CBN grinding wheel.

The result of the test is shown in FIG. 3. FIG. 3 indicates grinding wheel life on a longitudinal axis, and on a transversal axis grinding power converted from grinding force. A symbol "A" in FIG. 3 shows the type of 100% volume ratio of the single crystal CBN grinding particle 31 and a symbol "B" in FIG. 3 shows the type of 100% volume ratio of the multi crystal CBN grinding particle 32. A symbol "C1" shows the type that the volume ratio of the single crystal CBN grinding particle 31 to the multi crystal CBN grinding particle 32 is 90 to 10 and the average diameter ratio of the single crystal CBN grinding particle 31 to the multi crystal CBN grinding particle 32 is 1 to 1. A symbol "C2" shows the type that the volume ratio of the single crystal CBN grinding particle 31 to the multi crystal CBN grinding particle 32 is 90 to 10 and the average diameter ratio of the single crystal CBN grinding particle 31 to the multi crystal CBN grinding particle 32 is 2 to 3. A symbol "D1" shows the type that the volume ratio of the single crystal CBN grinding particle 31 to the multi crystal CBN grinding particle 32 is 75 to 25 and the average diameter ratio of the single crystal CBN grinding particle 31 to the multi crystal CBN grinding particle 32 is 1 to 1. A symbol "D2" shows the type that the volume ratio of the single crystal CBN grinding particle 31 to the multi crystal CBN grinding particle 32 is 75 to 25 and the average diameter ratio of the single crystal CBN grinding particle 31 to the multi crystal CBN grinding particle 32 is 2 to 3.

As shown in FIG. 3, the version having 100% volume ratio of the multi crystal CBN grinding particle 32 shown by "B" indicates improvement of the grinding wheel life but indicates large grinding force, converted to the grinding power in FIG. 3, in comparison with the type of the version having 100% volume ratio of the single crystal CBN grinding particle 31 shown by "A". Therefore, it is needed the grinding wheel 10 having the same grinding force to that of the type having 100% volume ratio of the single crystal CBN grinding particle 31 and having the improved grinding wheel life. Here is shown a linear line from "A" to "B" in both of which each type do not have the other of the multi crystal CBN grinding particle 32 nor the single crystal CBN grinding particle 31 in order to compare the type in "C1", "C2", "D1" and "D2" having blended materials of the single crystal CBN grinding particle 31 and the multi crystal CBN grinding particle 32 with that in "A" and "B".

Each of "C1", "C2", "D1" and "D2" is located under the linear line of "A" and "B" so that each of "C1", "C2", "D1" and "D2" shows reduced grinding force compared to a symbol having the same grinding wheel life. This results that it can reduce grinding force with maintaining the reasonable grinding wheel life by blending the single crystal CBN grinding particle 31 and the multi crystal CBN grinding particle 32.

Where the grinding force is too high, there is a possibility to happen to generate the grinding burning. Therefore, the grinding force should be controlled to comparably low level. The grinding force at "C1", "C2", "D1" or "D2" is not so large in comparison with that of the type having 100% volume ratio of the single crystal CBN grinding particle 31. As a result, the grinding force at "C1", "C2", "D1" or "D2" is useful. Therefore, the type of "C1", "C2", "D1" or "D2" improves the grinding wheel life extremely at same time that this type has the same grinding force compared to the type having 100% volume ratio of the single crystal CBN grinding particle 31.

Referred to FIG. 3, it will be explained a type having the different average diameter of the single crystal CBN grinding particle 31 from the average diameter of the multi crystal CBN grinding particle 32. That is comparison of "C1" and "C2", and comparison of "D1" and "D2" in FIG. 3.

Since the symbol "C2" shows the type that the volume ratio of the single crystal CBN grinding particle 31 to the multi crystal CBN grinding particle 32 is 90 to 10 and the average diameter of the single crystal CBN grinding particle 31 is two-thirds (⅔) of the average diameter of the multi crystal CBN grinding particle 32, the type of "C2" has almost same grinding wheel life but reduces the grinding force compared to that of "C1" having the same average diameter. Since the symbol "D2" shows the type that the volume ratio of the single crystal CBN grinding particle 31 to the multi crystal CBN grinding particle 32 is 75 to 25 and the average diameter of the single crystal CBN grinding particle 31 is two-thirds (⅔) of the average diameter of the multi crystal CBN grinding particle 32, the type of "D2" has almost same grinding wheel life but reduces the grinding force compared to that of "D1" having the same average diameter. Therefore, the grinding force can be reduced with same grinding wheel life by the way that the average diameter of the single crystal CBN grinding particle 31 is two-thirds (⅔) of the average diameter of the multi crystal CBN grinding particle 32.

"Verification"

It will be verified to reduce the grinding force extremely by mixing the single crystal CBN grinding particle 31 and the multi crystal CBN grinding particle 32. As shown in FIG. 2, the single crystal CBN grinding particle 31 and the multi crystal CBN grinding particle 32 are exposed from the vitrified bond adhesive material 33 on the outer peripheral surface of the grinding wheel 10. Each of the CBN grinding particles 31, 32 can grind the workpiece by being exposed from the vitrified bond adhesive material 33.

The single crystal CBN grinding particle 31 having the tetrahedron construction has the character being able to be torn or broken relatively easily by receiving load thereby to become a state having a sharpened cleavage surface, as explained above. On the other hand, since the multi crystal CBN grinding particle 32 has character of high tenacity, it is not easily torn nor broken as the single crystal CBN grinding particle 31 is. Therefore, it is tendency that the multi crystal CBN grinding particle 32 can be located in far position from the surface of the grinding wheel 10 and the single crystal CBN grinding particle 31 having the tetrahedron construction is located in inside position from the multi crystal CBN grinding particle 32 as shown in FIG. 2. By this construction, the multi crystal CBN grinding particle 32 can receive larger force in comparison with the single crystal CBN grinding particle 31 receiving smaller force.

By these constructions on the surface of the grinding wheel 10, the single crystal CBN grinding particle 31 having the tetrahedron construction can not be torn or broken easily by the way that the multi crystal CBN grinding particle 32 can achieve its superior wear resistance. Thereby, the grinding wheel life can be extended and reducing the grinding force can be steadily achieved by the single crystal CBN grinding wheel particle 31 having the tetrahedron construction. Where it is selected the type that the volume ratio of the single crystal CBN grinding wheel particle 31 is equal to or more than 50% volume, ratio of the exposed single crystal CBN grinding particle 31 is increased so that the workpiece can be steadily ground by the single crystal CBN grinding wheel particle 31 having the tetrahedron construction. Therefore, the grinding force can be steadily reduced.

Better is the version that the average diameter ratio of the single crystal CBN grinding particle 31 to that of the multi crystal CBN grinding particle 32 is equal to or less than four-fifths (4/5). By the construction that the average diameter of the single crystal CBN grinding particle 31 is less than that of the multi crystal CBN grinding particle 32, the multi crystal CBN grinding particle 32 is located in further position from the surface of the grinding wheel 10 than that of the single crystal CBN grinding particle 31, thereby it can locate the single crystal CBN grinding particle 31 having the tetrahedron construction in inside position from the multi crystal CBN grinding particle 32 as shown in FIG. 2.

In addition, best is the version that the average diameter ratio of the single crystal CBN grinding particle 31 to that of the multi crystal CBN grinding particle 32 is equal to or more than three-fifths (3/5). By the construction that the average diameter of the single crystal CBN grinding particle 31 is not too less than that of the multi crystal CBN grinding particle 32, the single crystal CBN grinding particle 31 can be steadily exposed from the vitrified bond adhesive material 33 on the surface of the grinding wheel 10. Therefore, by the construction that the average diameter ratio of the single crystal CBN grinding particle 31 to that of the multi crystal CBN grinding particle 32 is between three-fifths (3/5) and four-fifths (4/5), the multi crystal CBN grinding particle 32 can be located in far position from the surface of the grinding wheel 10 and the single crystal CBN grinding particle 31 having the tetrahedron construction can be located in inside position from the multi crystal CBN grinding particle 32.

The individually isolated fine cavities 33*c* are not continuous cavities communicated to the atmosphere and are formed within the vitrified bond adhesive material 33 embedded in the space between the CBN grinding particles 31, 32 so that holding power of the CBN grinding particles 31, 32 is increased. Thereby, the CBN grinding particles 31, 32 can be held in the above-identified state. In other words, the CBN grinding wheel 10 of the present invention can improve the wear resistance and reduce the grinding force by having the individually isolated fine cavities 33*c*. And the CBN grinding wheel 30 of the present invention can have good dressing ability by the individually isolated fine cavities 33*c*, thereby to have high performance for the CBN grinding wheel 30 by the individually isolated fine cavities 33*c*.

As explained above, the CBN grinding wheel 30 according to the present invention can reduce the grinding force and the wear by the above constructions. Reducing wear contributes to restrain the calorific value and to improve machining efficiency. Reducing wear improves the grinding wheel life. Reducing grinding force and wear is important factor especially in rough grinding. Therefore, the grinding wheel 10 is suitable for the rough grinding, thereby to be able to be used in replacing for turning.

While the invention has been described in detail with reference to the preferred embodiment, it will be apparent to those skilled in the art that the invention is not limited to the present embodiment, and that the invention may be realized in various other embodiments within the scope of the claims.

For example, while the adhesive material is the vitrified bond material in the embodiment, however the present invention is not limited to the construction, but it may be applied to various types of the adhesive material such as a metal bond.

What is claimed is:

1. A cubic boron nitride (CBN) grinding wheel comprising a CBN grinding particle and vitrified bond adhesive material, wherein;

said CBN grinding particle includes a single crystal CBN grinding particle having a tetrahedron construction and a multi crystal CBN grinding particle;

a volume content of said single crystal CBN grinding particle to a total summed volume of said single and multi CBN grinding particles is equal to or more than 50%;

a volume ratio of the vitrified bond adhesive material to the total volume of said single and multi CBN grinding particles is from 1:1 to 6:1; and a ratio of average diameter of said single crystal CBN grinding particle to average diameter of said multi crystal CBN grinding particle from three-fifths to four-fifths.

2. A cubic boron nitride (CBN) grinding wheel according to claim 1, wherein the volume ratio of said single crystal CBN grinding particle to a total summed volume of said single and multi CBN grinding particles is 9:1; and the diameter of said single crystal CBN grinding particle to a diameter of said multi crystal CBN grinding particle is 1:1.

3. A cubic boron nitride (CBN) grinding wheel according to claim 1, wherein the diameter of said single crystal CBN grinding particle to a diameter of said multi crystal CBN grinding particle is 1:1.5.

4. A cubic boron nitride (CBN) grinding wheel according to claim 1, wherein the volume ratio of said single crystal CBN grinding particle to a total summed volume of said single and multi CBN grinding particles is 3:1; and the diameter of said single crystal CBN grinding particle to a diameter of said multi crystal CBN grinding particle is 1:1.

5. A cubic boron nitride (CBN) grinding wheel according to claim 1, wherein the volume ratio of said single crystal CBN grinding particle to a total summed volume of said single and multi CBN grinding particles is 3:1; and the diameter of said single crystal CBN grinding particle to a diameter of said multi crystal CBN grinding particle is 1:1.5.

6. A cubic boron nitride (CBN) grinding wheel according to claim 1, wherein said adhesive material does not include therein continuous cavities to be communicated to an atmosphere but includes therein individually isolated fine cavities not to be communicated to said atmosphere.

7. A cubic boron nitride (CBN) grinding wheel according to claim 1, wherein said adhesive material includes an oxide material and an amorphous glass.

8. A cubic boron nitride (CBN) grinding wheel according to claim 2, wherein said adhesive material does not include therein continuous cavities to be communicated to an atmosphere but includes therein individually isolated fine cavities not to be communicated to said atmosphere.

9. A cubic boron nitride (CBN) grinding wheel according to claim 2, wherein said adhesive material includes an oxide material and an amorphous glass.

10. A cubic boron nitride (CBN) grinding wheel according to claim 3, wherein said adhesive material does not include therein continuous cavities to be communicated to an atmosphere but includes therein individually isolated fine cavities not to be communicated to said atmosphere.

11. A cubic boron nitride (CBN) grinding wheel according to claim 3, wherein said adhesive material includes an oxide material and an amorphous glass.

12. A cubic boron nitride (CBN) grinding wheel according to claim 4, wherein said adhesive material does not include therein continuous cavities to be communicated to an atmosphere but includes therein individually isolated fine cavities not to be communicated to said atmosphere.

13. A cubic boron nitride (CBN) grinding wheel according to claim 4, wherein said adhesive material includes an oxide material and an amorphous glass.

14. A cubic boron nitride (CBN) grinding wheel according to claim 5, wherein said adhesive material does not include therein continuous cavities to be communicated to an atmosphere but includes therein individually isolated fine cavities not to be communicated to said atmosphere.

15. A cubic boron nitride (CBN) grinding wheel according to claim 5, wherein said adhesive material includes an oxide material and an amorphous glass.

* * * * *